US010273968B2

(12) United States Patent
Wada

(10) Patent No.: US 10,273,968 B2
(45) Date of Patent: Apr. 30, 2019

(54) WATER SUPPLY/DRAINAGE PUMP

(71) Applicant: MATSUSAKA ENGINEERING CO., LTD., Tokyo (JP)

(72) Inventor: Yasuki Wada, Tokyo (JP)

(73) Assignee: MATSUSAKA ENGINEERING CO., LTD., Tokyo (JP)

( * ) Notice: Subject to any disclaimer, the term of this patent is extended or adjusted under 35 U.S.C. 154(b) by 216 days.

(21) Appl. No.: 15/282,137

(22) Filed: Sep. 30, 2016

(65) Prior Publication Data

US 2017/0097014 A1 Apr. 6, 2017

(30) Foreign Application Priority Data

Oct. 1, 2015 (JP) ..... 2015-196013
Aug. 19, 2016 (JP) ..... 2016-161179

(51) Int. Cl.

| | |
|---|---|
| ***F04D 13/02*** | (2006.01) |
| ***F04D 29/08*** | (2006.01) |
| ***F04D 29/66*** | (2006.01) |
| ***F04D 29/58*** | (2006.01) |
| ***F04D 29/42*** | (2006.01) |
| ***F01P 3/20*** | (2006.01) |

(52) U.S. Cl.

CPC ..... *F04D 29/086* (2013.01); *F01P 3/20* (2013.01); *F04D 13/02* (2013.01); *F04D 29/426* (2013.01); *F04D 29/5806* (2013.01); *F04D 29/669* (2013.01); *F01P 2060/16* (2013.01)

(58) Field of Classification Search

CPC ... F04B 17/05; F04B 53/08; F01P 5/02; F01P 5/04; F04D 29/086; F04D 29/426; F04D 29/669

See application file for complete search history.

(56) References Cited

U.S. PATENT DOCUMENTS

| | | | | |
|---|---|---|---|---|
| 3,981,610 A * | 9/1976 | Ernst | F01P 5/12 | 123/41.12 |
| 7,028,646 B1 * | 4/2006 | Wagner | F01P 5/04 | 123/41.12 |
| 2014/0007569 A1 * | 1/2014 | Gayton | F02G 1/055 | 60/508 |

FOREIGN PATENT DOCUMENTS

| | | |
|---|---|---|
| JP | S62-158118 U | 10/1987 |
| JP | 2001-152847 A | 6/2001 |

OTHER PUBLICATIONS

Office Action dated Nov. 18, 2016 in corresponding Japanese Application No. 2016-161179; 6 pages including English-language translation.

* cited by examiner

*Primary Examiner* — Patrick Hamo
(74) *Attorney, Agent, or Firm* — Maier & Maier, PLLC

(57) ABSTRACT

Provided is a water supply/drainage pump including: an air-cooled internal combustion engine section; a pump section configured to supply/drain water by being driven by the engine section; and a heat exchanger block arranged between the engine section and the pump section and configured to cool exhaust gas from the engine section. The heat exchanger block is mounted to a body of the pump section through intermediation of a first sealing plate. A fuel tank is mounted above a body of the engine section. Except a part corresponding to the pump section, parts corresponding to the engine section, the heat exchanger block, and the fuel tank are covered with a casing. The heat exchanger block is provided with a cooling passage, an exhaust passage, and a muffler passage.

9 Claims, 18 Drawing Sheets

WATER SUPPLY/DRAINAGE PUMP

BACKGROUND

The present invention relates to an engine-driven water supply/drainage pump configured to supply/drain water, and more particularly, to a water supply/drainage pump having a function to damp engine noise.

Hitherto, there have been known water supply/drainage pumps configured to be driven by an internal combustion engine. The water supply/drainage pumps are used in various fields such as agriculture and civil engineering, more specifically, irrigation, drainage, water pumping, and the like.

In recent years, in consideration of influence of noise of the engine on a surrounding environment, the possibility of providing a soundproof water supply/drainage pump including a soundproof cover configured to cover the engine and a pump such that leakage of the noise of the engine to an outside is prevented as much as possible has been investigated.

However, when the engine and the pump are covered with the soundproof cover in this way, sufficient ventilation is difficult to perform. As a result, the engine cannot be sufficiently cooled. In contrast, in order to obtain sufficient cooling performance, a large ventilation hole needs to be formed through the soundproof cover. As a result, noise damping performance is degraded.

In order to solve such problems, development of an engine-driven water supply/drainage pump having both a cooling function and a noise damping function has been demanded.

Under such circumstances, as a water supply/drainage pump having both the cooling function and the noise damping function, the inventor of the present application has been proposed a soundproof engine pump disclosed in Japanese Patent Application Laid-open No. 2001-152847.

SUMMARY

In the soundproof engine pump disclosed in Japanese Patent Application Laid-open No. 2001-152847, an engine section and a pump section are housed in the casing. The engine section and the pump section are mounted integrally to each other. An exhaust pipe and a muffler are connected to each other in the casing, and exhaust gas is discharged to an outside of the casing through the exhaust pipe. Further, the exhaust pipe and the muffler are covered with a cooling jacket incorporated in the casing.

In addition, cooling conduits of the cooling jacket are assembled around the exhaust pipe and the muffler, and the cooling conduits are connected to a drain conduit of the pump.

In the soundproof engine pump configured as described above, a piping system of an entirety of the pump is complicated. As a result, assembly of the entirety of the pump is troublesome.

Further, in order to protect the exhaust pipe, the muffler, the cooling jacket, and other components at the time of using the pump, the entirety of the pump is covered with the casing. In this way, there has been a problem in that the pump is inevitably increased in size.

The present invention has been made to solve the related-art problems as described above, and has an object to provide a water supply/drainage pump in which a piping system including an exhaust pipe can be simplified, which facilitates assembly, and which has both a cooling function and a noise damping function.

Further, the present invention also has an object to provide a water supply/drainage pump that contributes to downsizing of the water supply/drainage itself.

In order to solve the related-art problems as described above, and to achieve the objects, according to an embodiment of the present invention, there is provided a water supply/drainage pump, including:

- an engine section;
- a pump section configured to supply/drain water by being driven by the engine section; and
- a heat exchanger block mounted to a body of the pump section between the engine section and the pump section,
- the heat exchanger block including
  - an exhaust passage connected to an exhaust port for the engine section, and
  - a cooling passage formed along the exhaust passage and being continuous with a water supply/drainage passage formed in the body of the pump section.

With this configuration, a piping system of an entirety of the water supply/drainage pump is simplified, and hence the water supply/drainage pump can be easily assembled.

It is preferred that, in the water supply/drainage pump according to the embodiment of the present invention, the heat exchanger block further include a muffler passage continuous with the exhaust passage.

With this configuration, effect of damping noise of exhaust gas can be increased.

It is preferred that the water supply/drainage pump according to the embodiment of the present invention further include a volute chamber formed between the body of the pump section and the heat exchanger block,

- the heat exchanger block further including:
  - a water inlet configured to allow water in the water supply/drainage passage to be caused to flow into the cooling passage via the volute chamber; and
  - a water outlet configured to allow the water in the cooling passage to be drained into the water supply/drainage passage.

With this configuration, arrangement of the cooling passage can be facilitated.

It is preferred that, in the water supply/drainage pump according to the embodiment of the present invention, the engine section include a pump drive shaft,

- the pump drive shaft having a front end to be inserted into the volute chamber through the heat exchanger block, and including a water supply/drainage impeller mounted to the front end.

Also with this configuration, the arrangement of the cooling passage can be facilitated.

It is preferred that, in the water supply/drainage pump according to the embodiment of the present invention, the exhaust passage include a radiating fin.

With this configuration, effect of radiating heat of the exhaust gas can be increased.

It is preferred that, in the water supply/drainage pump according to the embodiment of the present invention, the heat exchanger block be made of die-cast aluminum.

Also with this configuration, the effect of radiating the heat of the exhaust gas can be increased.

It is preferred that, the water supply/drainage pump according to the embodiment of the present invention further include a casing configured to cover the engine section and the heat exchanger block and including a partition plate, the engine section and the heat exchanger block being located on an inside of the casing with respect to the partition plate of the casing, the pump section being located on an outside of the casing with respect to the partition plate.

With this configuration, operating noise of the engine section, noise generated by the heat exchanger block, and other noises can be restrained from leaking to the outside.

Further, the heat exchanger block is mounted to the body of the pump section between the engine section and the pump section. Thus, an inlet and outlets of the body of the pump section are not covered with the casing. With this, hoses can be easily connected to/disconnected from the inlet and the outlets of the pump section.

It is preferred that, the water supply/drainage pump according to the embodiment of the present invention further include a sealing member that has a vibration damping function and a noise damping function, and is fitted to a joint part between the partition plate and the heat exchanger block.

With this configuration, noise leakage from the joint part between the partition plate and the heat exchanger block can be prevented. In addition, vibration of the entirety of the water supply/drainage pump and vibration of the casing during operation of the pump section can be alleviated.

It is preferred that, in the water supply/drainage pump according to the embodiment of the present invention, the casing be provided with an exhaust port configured to allow air on the inside of the casing to be discharged to the outside of the casing.

With this configuration, gases such as the exhaust gas that is discharged from the engine section and stagnates in the casing can be discharged to the outside.

It is preferred that, in the water supply/drainage pump according to the embodiment of the present invention, the pump section include:

an opening portion formed through a front portion of the pump section and communicating to an inside of the pump section; and a freely openable/closable lid member mounted to the opening portion.

With this configuration, even without removing the casing, the inside of the pump section can be easily cleaned.

According to the embodiment of the present invention, it is possible to provide a downsized water supply/drainage pump in which the piping system including the exhaust passage can be simplified, which facilitates assembly of the water supply/drainage pump, and which has both the cooling function and the noise damping function.

BRIEF DESCRIPTION OF DRAWINGS

FIG. 11(*a*) is a perspective view; and FIG. 11(*b*) is an enlarged perspective view;

DETAILED DESCRIPTION OF EMBODIMENTS

Now, a water supply/drainage pump 1 according to an embodiment of the present invention is described.

Figure 1:
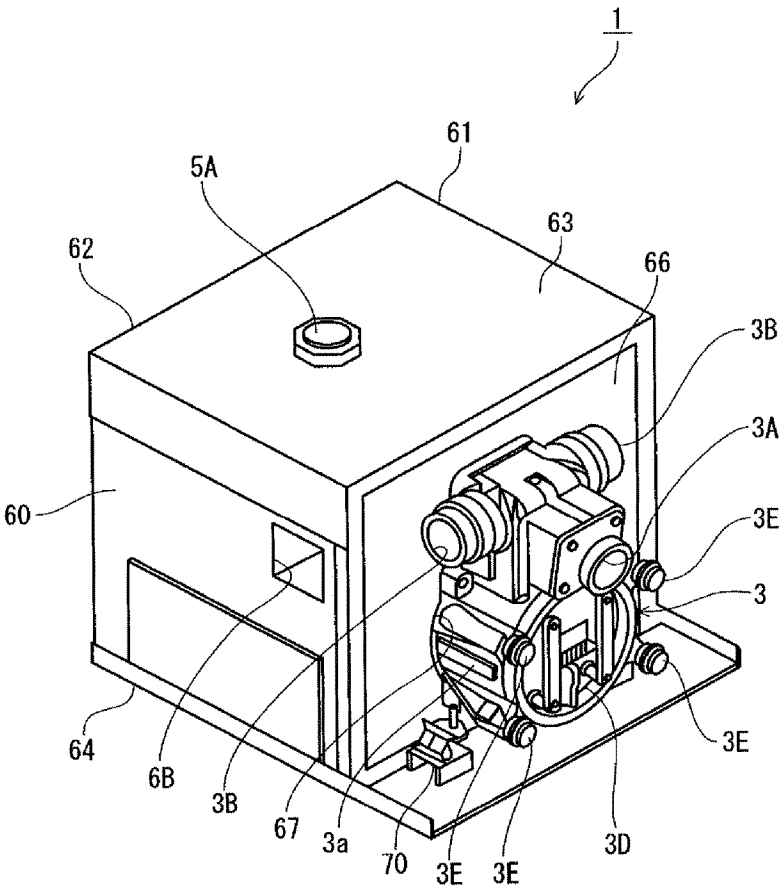
FIG. 1 is an external perspective view of a water supply/drainage pump according to an embodiment of the present invention.
Figure 2:
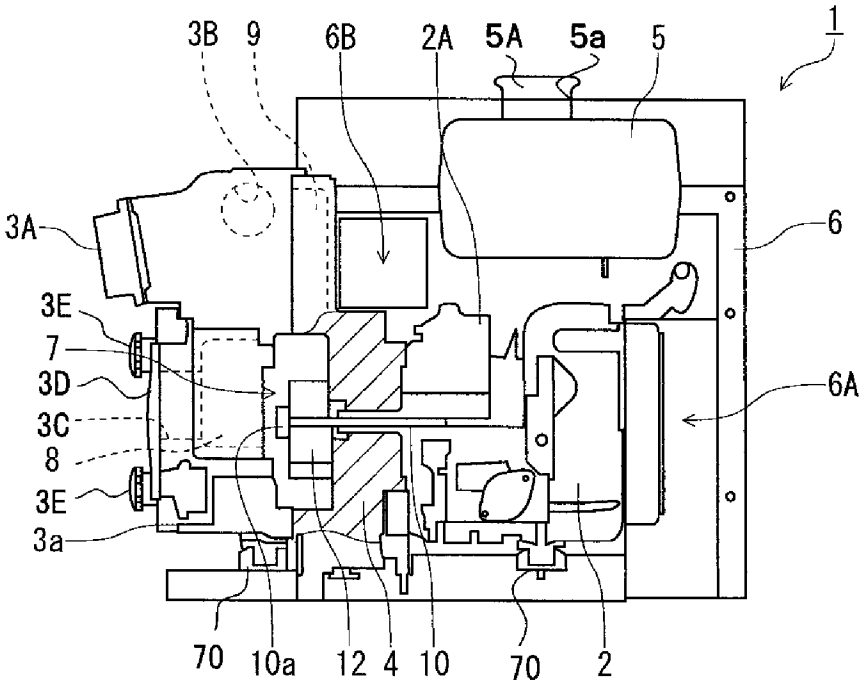
FIG. 2 is a partially cutaway side view of an internal structure of the water supply/drainage pump.
Figure 3:
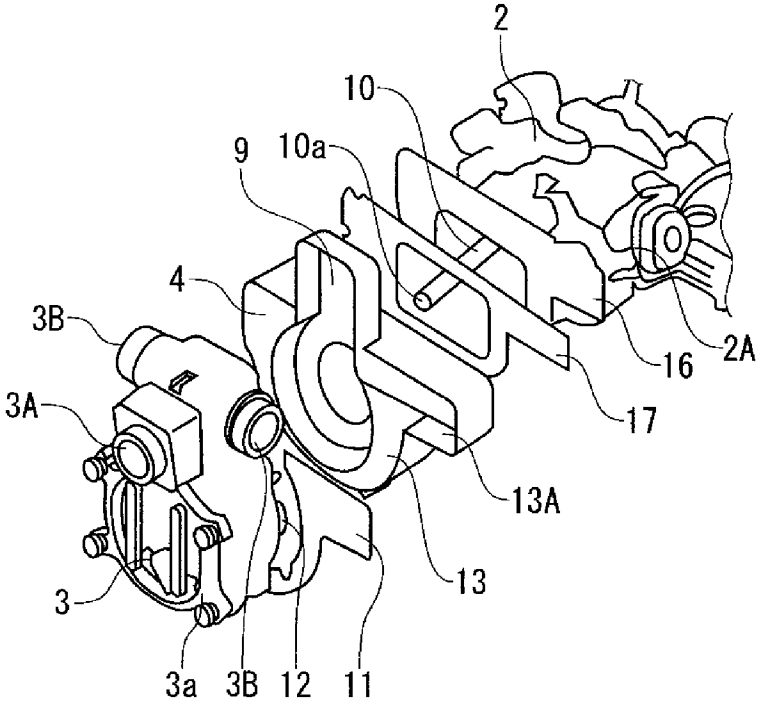
FIG. 3 is an exploded perspective view of the internal structure of the water supply/drainage pump.
Figure 4:
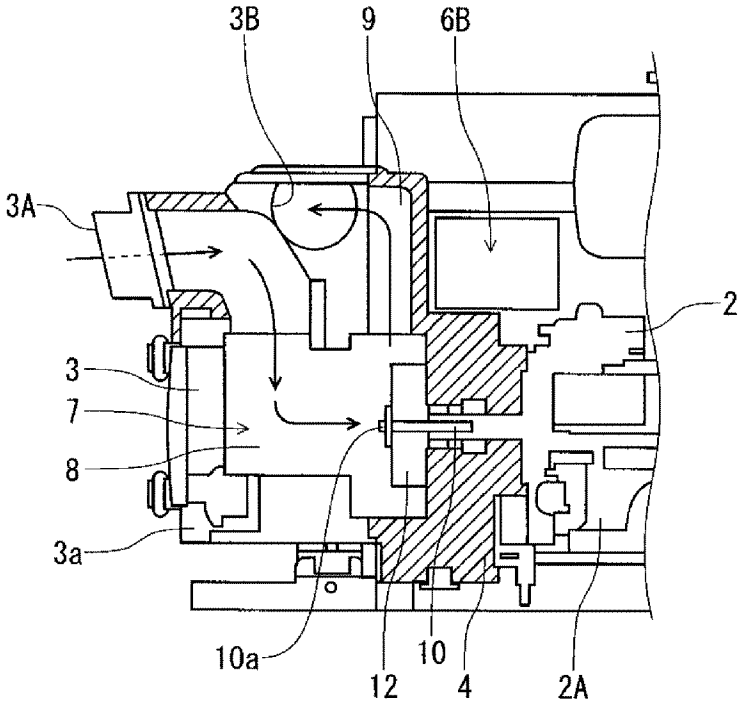
FIG. 4 is a partially cutaway side view of an internal structure of a pump section.
Figure 5:
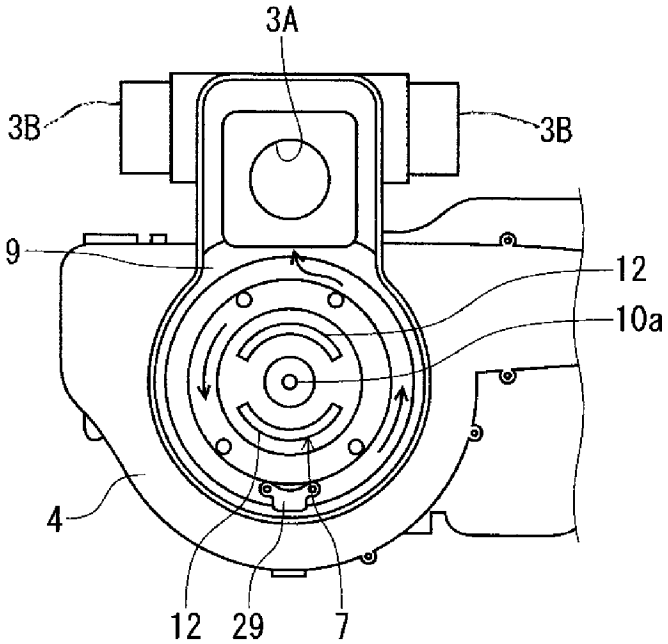
FIG. 5 is a front view of the internal structure of the pump section.

FIG. 1 is an external perspective view of the water supply/drainage pump 1. FIG. 2 is a partially cutaway side view for illustrating an internal structure of the water supply/drainage pump 1. FIG. 3 is an exploded perspective view for illustrating the internal structure of the water supply/drainage pump 1. FIG. 4 is a partially cutaway side view for illustrating how water is supplied to/drained from an inside of a pump section 3. FIG. 5 is a front view for illustrating how the water is supplied to/drained from the inside of the pump section 3.

(Overall Structure of Water Supply/Drainage Pump)

As illustrated in FIG. 1 to FIG. 5, the water supply/drainage pump 1 includes an engine section 2, the pump section 3 configured to supply/drain the water by being driven by the engine section 2, and a heat exchanger block 4 arranged between the engine section 2 and the pump section 3 and configured to cool exhaust gas from the engine section 2. The engine section 2 and the heat exchanger block 4 are covered with a box-shaped casing 6.

(Engine Section)

The engine section 2 is an air-cooled internal combustion engine. A pump drive shaft 10 is mounted integrally to a drive shaft (not shown). A front end 10*a* of the pump drive shaft 10 is inserted into a volute chamber 7 of the pump section 3 through the heat exchanger block 4. An impeller 12 is mounted to the front end 10*a*. Further, a cooling fan (not shown) of the engine section 2 is mounted to a rear end of the pump drive shaft 10 of the engine section 2.

In the casing 6, a fuel tank 5 is mounted above a body 2A of the engine section 2.

(Pump Section)

The pump section 3 includes a body 3*a* made of die-cast aluminum, an inlet 3A opened on an upper side of a front portion of the body 3*a*, and outlets 3B and 3B coaxially opened on an upper side of both right and left side portions of the body 3*a*.

The volute chamber 7 is formed between the body 3*a* of the pump section 3 and the heat exchanger block 4. The volute chamber 7 communicates to a first chamber 8 that serves as a water supply/drainage passage. A front side of the heat exchanger block 4 is provided with a second chamber 9 communicating to the volute chamber 7.

The inlet 3A communicates to the first chamber 8, and the first chamber 8 communicates to the volute chamber 7. The outlets 3B and 3B communicate to the second chamber 9.

A central part of the second chamber 9 is provided with a shaft hole 4A configured to allow the front end 10*a* of the pump drive shaft 10 to be inserted therethrough. The front end 10*a* of the pump drive shaft 10 is inserted into the second chamber 9 through the shaft hole 4A. In addition, the impeller 12 arranged in the volute chamber 7 is mounted to the front end 10*a*.

When the impeller 12 in the volute chamber 7 is rotated, as indicated by the arrows in FIG. 4, the water is taken into the first chamber 8 through the inlet 3A. As indicated by the arrows in FIG. 4, the water in the first chamber 8 is caused to flow into the second chamber 9 through the volute chamber 7. Then, as indicated by the arrow in FIG. 4, the water in the second chamber 9 is drained to an outside through the outlets 3B and 3B.

Specifically, in a case of supplying/draining water for irrigation channels, first, the pump drive shaft 10 of the engine section 2 is driven so as to rotate the impeller 12 in the volute chamber 7. With this, pressure is generated by the rotation of the impeller 12, and the water is taken into the first chamber 8 through the inlet 3A. The water taken into the first chamber 8 is caused to flow into the second chamber 9. Then, the water caused to flow into the second chamber 9 is drained to the outside through the outlets 3B and 3B.

A lower side of the front portion of the pump section 3 is provided with an opening portion 3C communicating to the volute chamber 7. A freely openable/closable lid member 3D is mounted with screws 3E to the opening portion 3C. Thus, by operations of opening/closing the lid member 3D, an inside of the volute chamber 7 can be easily cleaned.

(Heat Exchanger Block)

Next, with reference to FIG. 6 to FIG. 12, a structure of the heat exchanger block 4 is described in detail.

Figure 6:
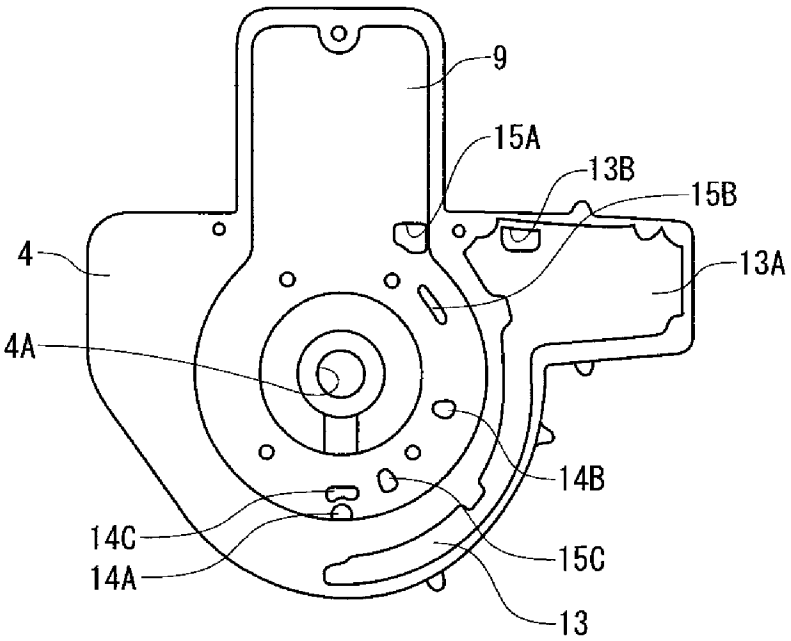
FIG. 6 is a front view of a heat exchanger block as viewed from the pump section side.
Figure 7:
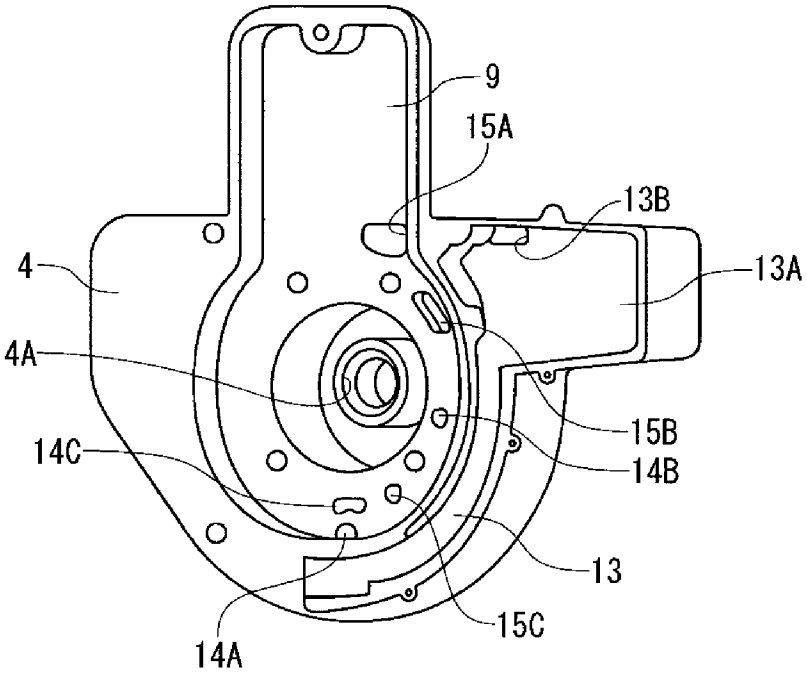
FIG. 7 is a perspective view of the heat exchanger block as viewed from the pump section side.
Figure 8:
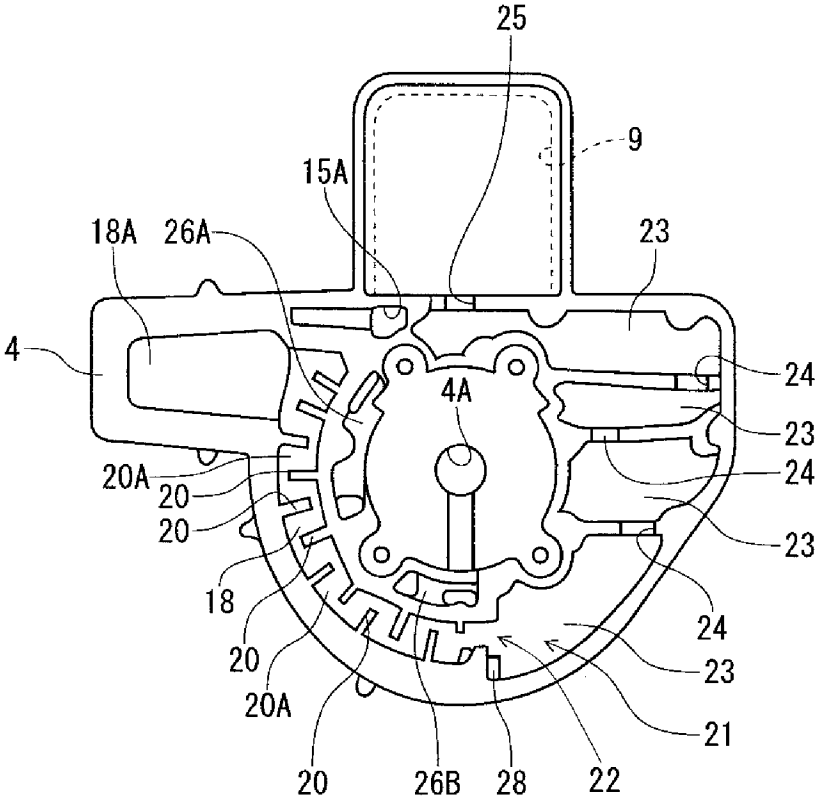
FIG. 8 is a rear view of the heat exchanger block as viewed from an engine section side.
Figure 9:
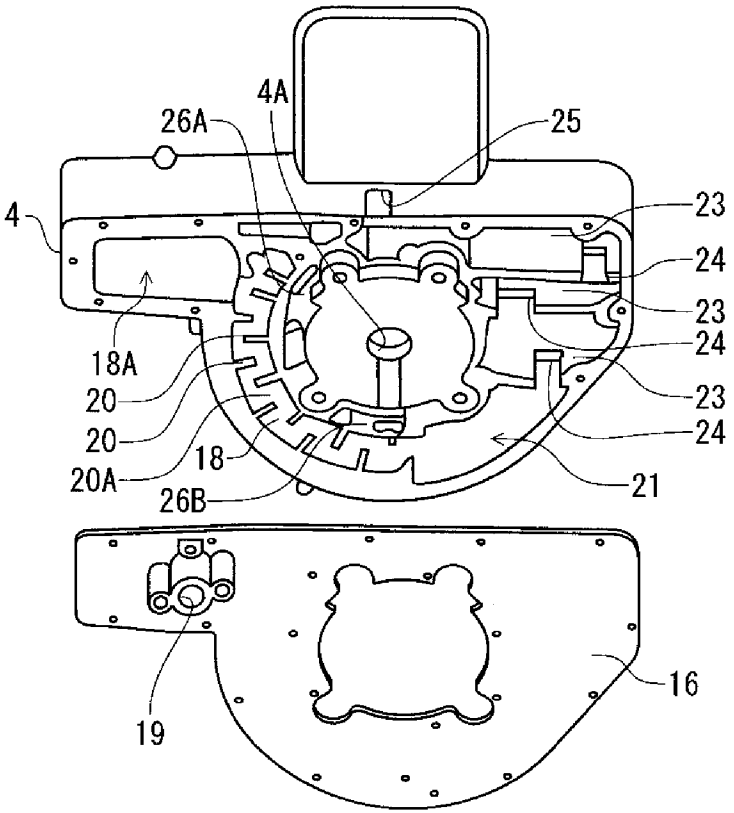
FIG. 9 is an exploded perspective view of the heat exchanger block as viewed from the engine section side.
Figure 10:
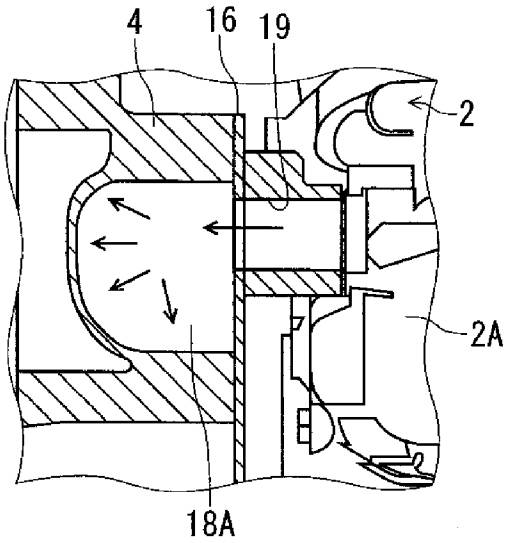
FIG. 10 is an enlarged sectional view of a part of the heat exchanger block which part includes an exhaust chamber.
Figure 11:
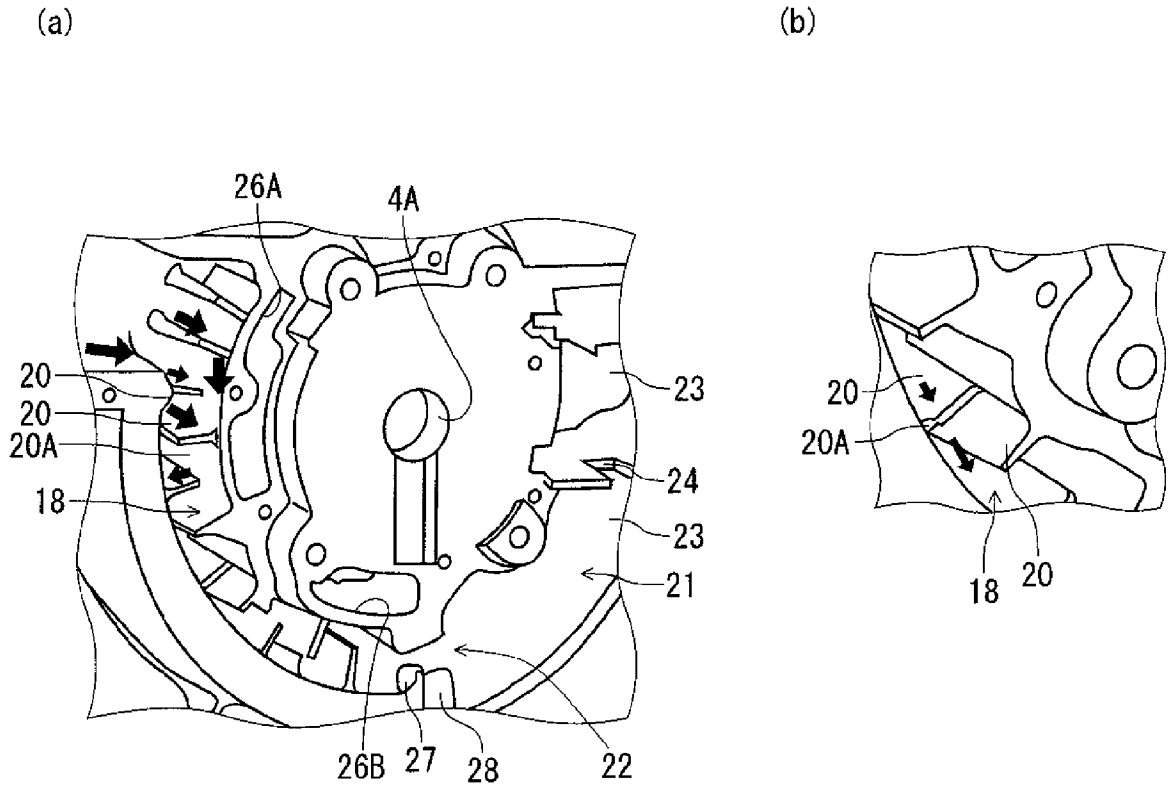
FIG. 11 are views of a part of the heat exchanger block which part includes an exhaust passage.
Figure 12:
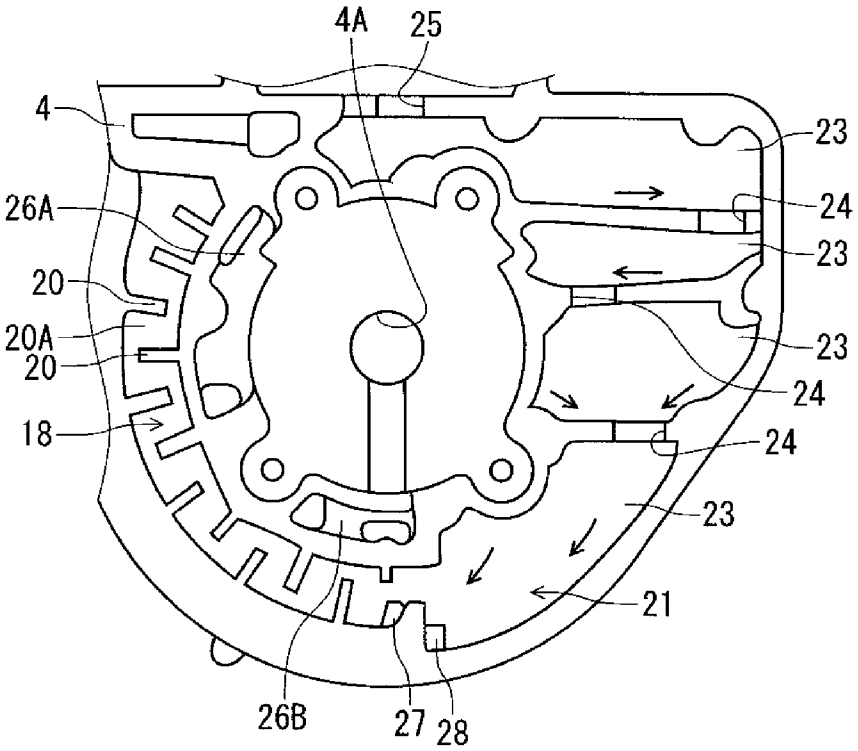
FIG. 12 is a rear view of a part of the heat exchanger block which part includes a muffler passage.

FIG. 6 is a front view for illustrating the second chamber 9 of the heat exchanger block 4. FIG. 7 is a perspective view for illustrating a cooling passage 13 of the heat exchanger block 4. FIG. 8 is a rear view for illustrating an exhaust passage 18 of the heat exchanger block 4. FIG. 9 is an exploded perspective view for illustrating the exhaust passage 18 and a muffler passage 21 of the heat exchanger block 4. FIG. 10 is an enlarged sectional view for illustrating an exhaust chamber 18A of the heat exchanger block 4. FIGS. 11 are views of a part of the heat exchanger block 4 which part includes the exhaust passage 18; FIG. 11(*a*) is a perspective view; and FIG. 11(*b*) is an enlarged perspective view. FIG. 12 is a rear view for illustrating the muffler passage 21.

The heat exchanger block 4 is made of die-cast aluminum excellent in heat radiation efficiency.

As illustrated in FIG. 6, in the heat exchanger block 4, specifically, on a side of a front surface portion that is mounted to the body 3*a* of the pump section 3, the cooling passage 13 having a circular-arc shape is formed in a manner of surrounding a part corresponding to substantially half of a circumference of the second chamber 9.

The heat exchanger block 4 is mounted to the body 3*a* of the pump section 3 through intermediation of a first sealing plate 11 (refer to FIG. 3). Note that, the heat exchanger block 4 mounted to the body 3*a* of the pump section 3 is freely removable. Thus, in case where foreign matter such as dust clogs on the way in the cooling passage 13 described below, and needs to be removed, or when the heat exchanger block 4 needs to be overhauled, such work can be easily carried out.

The cooling passage 13 is sealed and waterproofed by the first sealing plate 11.

A lower side of a back wall of the second chamber 9 is provided with a first water inlet 14A formed so as to communicate to the cooling passage 13. The water in the second chamber 9 is caused to flow into the cooling passage 13 through the first water inlet 14A.

An upper side of the back wall of the second chamber 9 is provided with a first water outlet 15A. An upper side of the cooling passage 13 is provided with a cooling chamber 13A. The cooling chamber 13A is provided with a chamber connection port 13B. The chamber connection port 13B and the first water outlet 15A communicate to each other.

The water caused to flow into the cooling passage 13 is returned to the second chamber 9 through the cooling chamber 13A, the chamber connection port 13B, and the first water outlet 15A. Note that, the back wall of the second chamber 9 is also provided with a second water inlet 14B and a third water inlet 14C that communicate to the cooling passage 13.

Specifically, by driving and rotating the impeller 12 arranged in the volute chamber 7, the water taken into the first chamber 8 is caused to flow sequentially through the second chamber 9, the cooling passage 13, and the second chamber 9.

With such a configuration, the water supplied/drained by the pump section 3 can be used as coolant for the cooling passage 13. Thus, temperature of the coolant to be caused to flow into the cooling passage 13 can be maintained at appropriate temperature. In this way, performance of cooling the exhaust passage 18 described below can be enhanced.

The rear of the heat exchanger block 4 is mounted to the body 2A of the engine section 2 through intermediation of a base plate 16 and a second sealing plate 17 (refer to FIG. 3). Behind the heat exchanger block 4, specifically, behind the cooling passage 13, a circular-arc exhaust passage 18 is formed along the cooling passage 13.

An upper portion of the exhaust passage 18 is provided with the exhaust chamber 18A having a dome shape. The base plate 16 is provided with a first exhaust port 19 configured to guide the exhaust gas, which is discharged from the engine section 2, into the exhaust passage 18. Behind the exhaust chamber 18A, the cooling chamber 13A being a part of the cooling passage 13 is formed in accordance with a size of the exhaust chamber 18A.

As indicated by the arrows in FIG. 10, the exhaust gas discharged through the first exhaust port 19 is once received by the exhaust chamber 18A, and then dispersed. Then, the exhaust gas is caused to flow into the muffler passage 21 through the exhaust passage 18, and then discharged to the outside through a second exhaust port 25.

As described above, by forming the exhaust chamber 18A configured to dissipate heat of the exhaust gas in the exhaust passage 18, and by forming the cooling chamber 13A along the exhaust chamber 18A, a large surface area of cooling the exhaust gas can be secured. With this, development of hot spots can be prevented.

In the exhaust passage 18, a plurality of radiating fins 20 are formed in a stepped pattern at a predetermined interval along a direction of discharging the exhaust gas. By virtue of the radiating fins 20, exhaust pressure can be adjusted, and exhaust temperature can be adjusted to appropriate temperature. In addition, the exhaust gas is discharged to a lower side of the exhaust passage 18 through clearances 20A formed between the radiating fins 20.

The rear of the heat exchanger block 4 is also provided with the muffler passage 21 continuous with the exhaust passage 18. A lower portion of the exhaust passage 18 is provided with a first exhaust-gas connection port 22 communicating to the muffler passage 21. Through the first exhaust-gas connection port 22, the exhaust gas in the exhaust passage 18 is discharged into the muffler passage 21.

The muffler passage 21 is partitioned into a plurality of muffler chambers 23. The muffler chambers are located in the the direction of discharging the exhaust gas. A bottom wall of each of the muffler chambers 23 is provided with a second exhaust-gas connection port 24 communicating to adjacent ones of the muffler chambers 23 above and below.

By partitioning the muffler passage 21 into the plurality of muffler chambers 23, a silencing effect can be enhanced.

An upper portion of the muffler passage 21 is provided with the second exhaust port 25 configured to allow the exhaust gas in the muffler passage 21 to be discharged into the casing 6.

The exhaust passage 18 is sealed by the second sealing plate 17 such that the exhaust gas does not leak from the engine section 2 directly into the casing 6.

The rear of the heat exchanger block 4 is provided with a first coolant-pool portion 26A communicating to the second water inlet 14B and a second water outlet 15B that are formed through the back wall of the second chamber 9. The coolant in the second chamber 9 is caused to flow into the first coolant-pool portion 26A through the second water inlet 14B. Then, the coolant in the first coolant-pool portion 26A is returned into the second chamber 9 through the second water outlet 15B.

Further, the rear of the heat exchanger block 4 is provided with a second coolant-pool portion 26B communicating to the third water inlet 14C and a third water outlet 15C that are formed through the back wall of the second chamber 9. The coolant in the second chamber 9 is caused to flow into the second coolant-pool portion 26B through the third water inlet 14C. Then, the coolant in the second coolant-pool portion 26B is returned into the second chamber 9 through the third water outlet 15C.

In the water supply/drainage pump 1 configured as described above, the coolant is caused to flow into the cooling passage 13 and the coolant pool portions 26A and 26B. With this, the exhaust passage 18 can be cooled. Thus, in the exhaust passage 18, thermal expansion of the exhaust gas can be restrained, and noise of the exhaust gas can be damped. In addition, the thermal expansion of the exhaust gas can be restrained before the exhaust gas is discharged into the muffler passage 21. With this, unlike the related art, the heat of the exhaust gas is not radiated from the muffler passage 21.

Further, the heat exchanger block 4 is made of a die-cast aluminum excellent in heat radiation efficiency. With this, cooling effect by the exhaust passage 18 can be increased. As a result, the noise damping effect can be increased.

In addition, also after the pump section 3 stops driving, the coolant in the cooling passage 13 continues to be convected by temperature difference. With this, the coolant to be used in the cooling passage 13 can be maintained at appropriate temperature.

In the exhaust passage 18, explosive noise of the exhaust gas is damped, and then the exhaust gas is caused to flow into the muffler passage 21 such that the noise of the exhaust gas can be further damped in the muffler passage 21. With this, performance of damping the noise of the exhaust gas to be discharged into the casing 6 through the muffler passage 21 is further enhanced.

In addition, in the heat exchanger block 4, the muffler passage 21 is located along an outer portion of the second chamber 9 therebehind. Thus, the muffler passage 21 also can be cooled by the coolant in the second chamber 9.

Even when condensed water is generated in the exhaust passage 18 as a result of cooling the exhaust gas in the exhaust passage 18, as indicated by the arrows in FIG. 11(*a*) and FIG. 11(*b*), the condensed water is guided downward by back pressure (pressure of the exhaust gas) through the clearances 20A between the radiating fins 20. In other words, the condensed water is guided sequentially from the upper portion to the lower portion of the exhaust passage 18. The lower portion of the exhaust passage 18 is provided with a first drain 27, and the condensed water guided to the lower portion of the exhaust passage 18 is drained to the outside through the first drain 27.

Further, even when condensed water is generated in the muffler passage 21 as a result of cooling the exhaust gas in the muffler passage 21, as indicated by the arrows in FIG. 12, the condensed water flows along the bottom walls of the muffler chambers 23, and is guided sequentially into lower ones of the muffler chambers 23 through the second exhaust-gas connection ports 24. A lower portion of the muffler passage 21 is provided with a second drain 28, and the condensed water guided to the lower portion of the muffler passage 21 is drained to the outside through the second drain 28.

With such a configuration, even when the condensed water is generated as a result of cooling the exhaust passage 18 and the muffler passage 21, the condensed water is drained to the outside through the first drain 27 and the second drain 28. With this, it is possible to effectively prevent the heat exchanger block 4 made of die-cast aluminum from being deteriorated, specifically, being deformed through corrosion by influence of components of the exhaust gas (such as sulfur) which components are contained in the condensed water.

Figure 13:
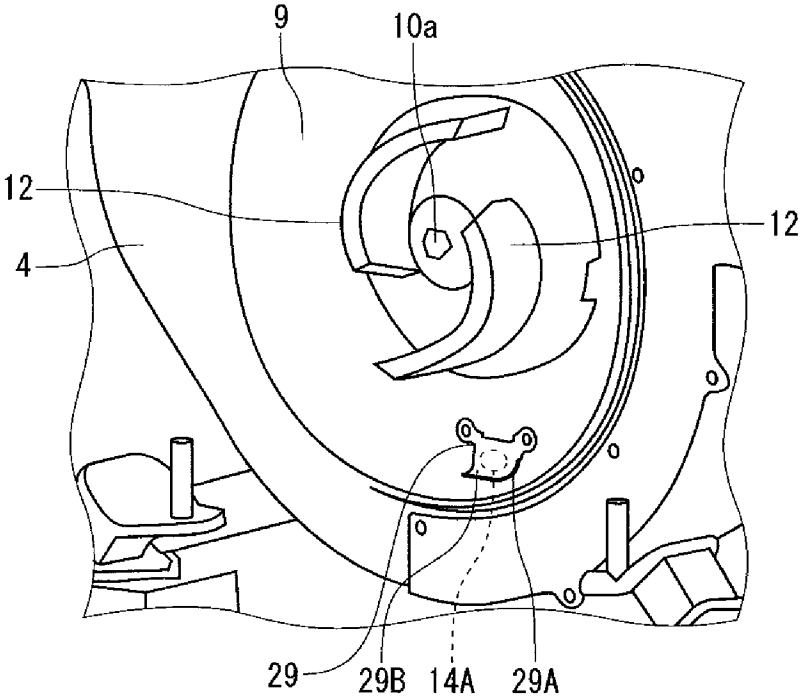
FIG. 13 is a perspective view of a part of the heat exchanger block which part includes a second chamber.
Figure 14:
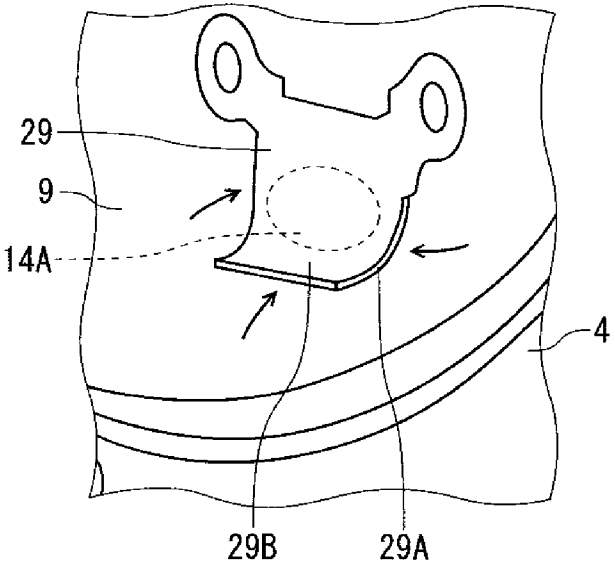
FIG. 14 is an enlarged perspective view of a part of the second chamber of the heat exchanger block which part includes a first water inlet.

As illustrated in FIG. 13 and FIG. 14, a stopper flap 29 configured to restrain foreign matter such as pebbles from entering the cooling passage 13 through the first water inlet 14A is mounted to a lower portion of the second chamber 9 of the heat exchanger block 4. A clearance 29A is secured between a curved portion 29B of the stopper flap 29 and the back wall of the second chamber 9. With this, a flow path for the coolant into the first water inlet 14A is narrowed.

With such a configuration, in a case where the water supply/drainage pump 1 is used for supplying/draining the water for the irrigation channels, even when the foreign matter such as pebbles is contained in the water to be supplied and enters the first chamber 8, the foreign matter such as pebbles can be caught in the clearance 29A. In this way, the foreign matter can be prevented from entering the cooling passage 13 through the first water inlet 14A. In addition, the stopper flap 29 mounted as described above is capable of adjusting a size of the clearance 29A. Thus, in a case of supplying/draining water containing sand, by setting the size of the clearance 29A as small as possible, the sand can be prevented from entering the cooling passage 13.

Figure 15:
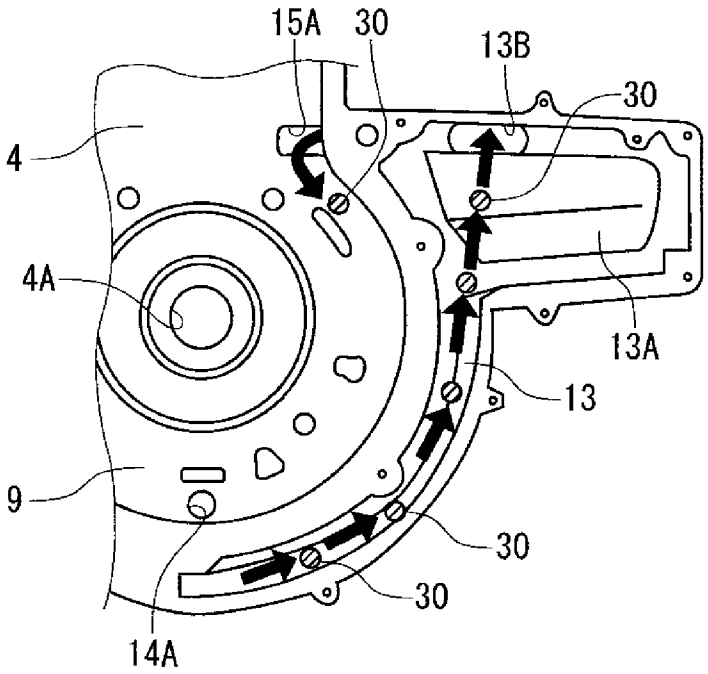
FIG. 15 is a front view of a cooling passage of the heat exchanger block as viewed from the pump section side.
Figure 16:
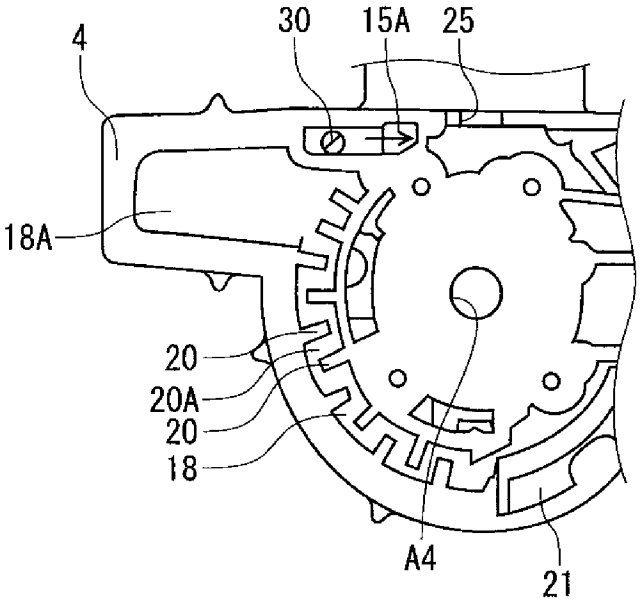
FIG. 16 is a rear view of the exhaust passage of the heat exchanger block as viewed from the engine section side.

In case where foreign matter 30 enters the cooling passage 13, as indicated by the arrows in FIG. 15, the foreign matter 30 is moved from a lower side to an upper side of the cooling passage 13 by pressure of supplying/draining the water with the pump section 3. Then, as indicated by the arrow in FIG.

16, the foreign matter 30 is moved from the chamber connection port 13B to the first water outlet 15A, and lastly moved back to the second chamber 9. In this way, the foreign matter 30 can be prevented from stagnating in the cooling passage 13, and the cooling passage 13 can be prevented from being clogged with the foreign matter 30.

(Casing)

Figure 17:
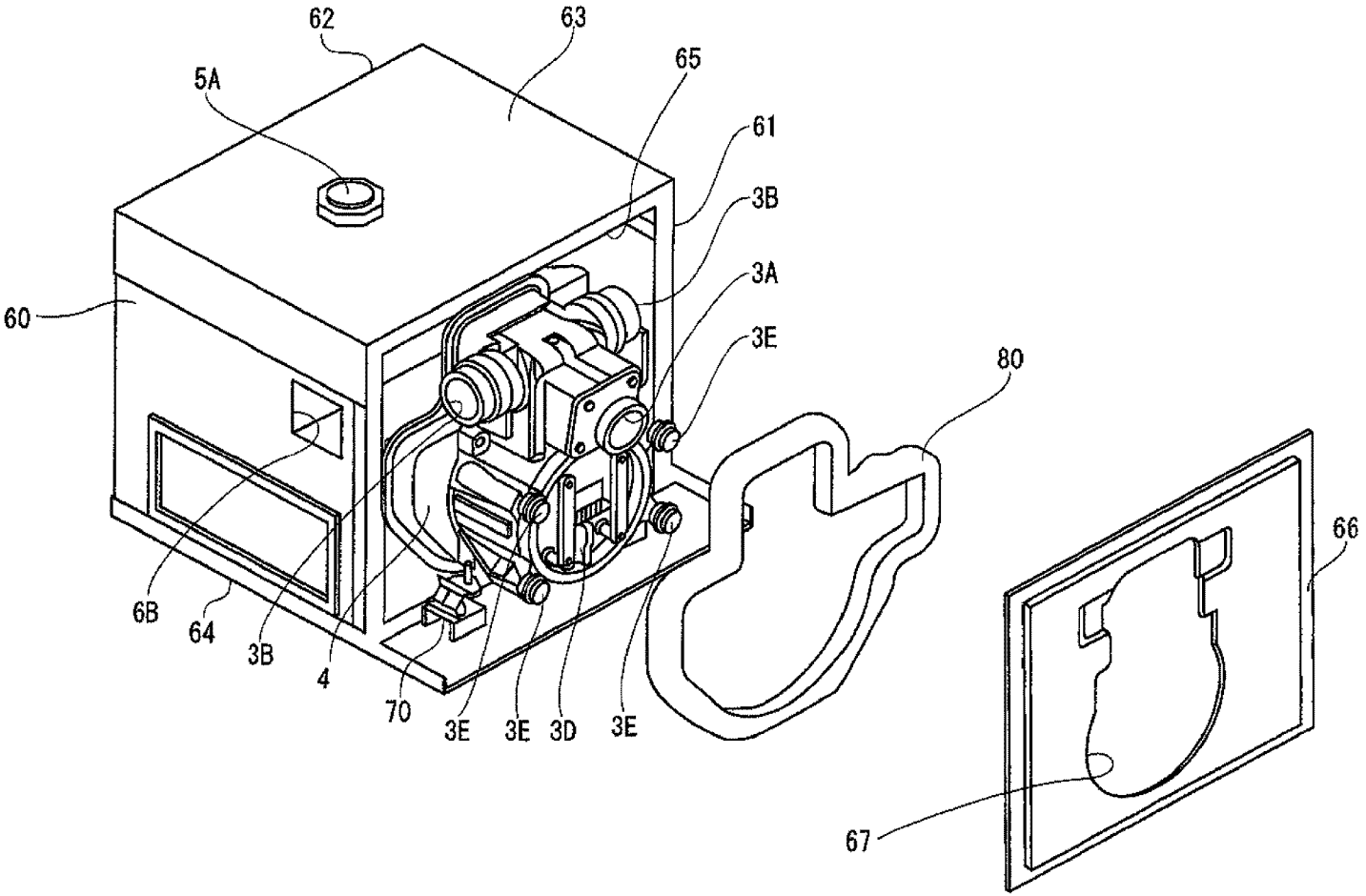
FIG. 17 is an exploded perspective view of the water supply/drainage pump.
Figure 18:
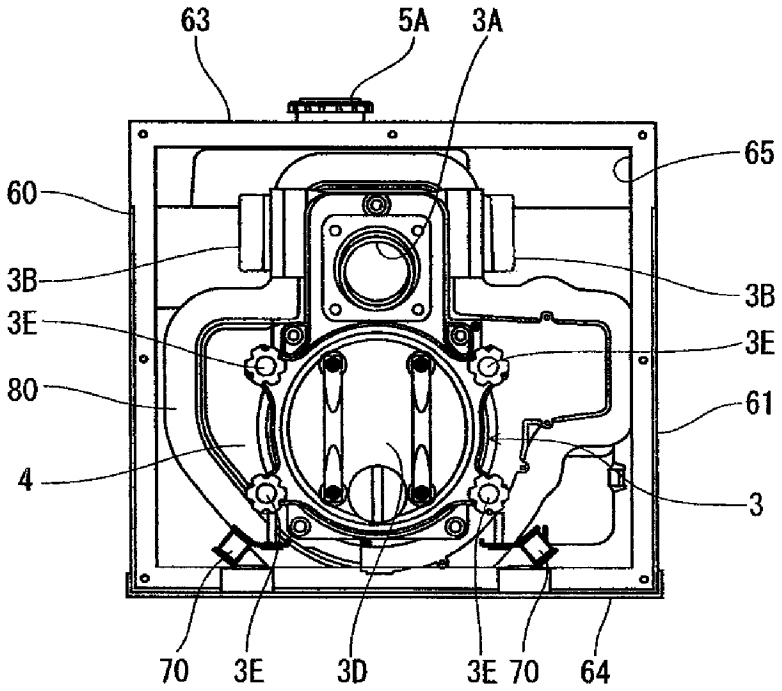
FIG. 18 is a front view illustrating a state in which a partition plate of a casing of the water supply/drainage pump is removed.

As illustrated in FIG. 17 and FIG. 18, the engine section 2 and the heat exchanger block 4 are covered with the box-shaped casing 6. The casing 6 includes both a left side plate 60 and a right side plate 61, a rear side plate 62, a top plate 63, and a bottom plate 64. In the casing 6, a front side on which the pump section 3 is located is opened, and an opening portion 65 is formed thereat. A partition plate 66, which is freely removable, is mounted to the opening portion 65, and the opening portion 65 is freely opened/closed by the partition plate 66.

The engine section 2 and the heat exchanger block 4 are located on an inside of the casing 6 with respect to the partition plate 66 of the casing 6, and the pump section 3 is located on an outside of the casing 6 with respect to the partition plate 66.

Note that, in the present invention, the left and right side plates 60 and 61, the rear side plate 62, the top plate 63, and the bottom plate 64 may be formed integrally with each other in advance.

A fuel filler port 5*a* of the fuel tank 5 is opened in the top plate 63, and a fuel filler cap 5A is fitted to the fuel filler port 5*a*.

The engine section 2, the pump section 3, and the heat exchanger block 4 are elastically supported by vibration-damping leg portions 70 arranged on the bottom plate 64 of the casing 6. With this, vibration of the engine section 2, the pump section 3, and the heat exchanger block 4 during operation is absorbed by the vibration-damping leg portions 70.

In the casing 6, a casing-side intake port 6A (refer to FIG. 2) configured to allow air for cooling the engine section 2 to be taken into the casing 6 is opened behind the engine section 2. Further, a casing-side exhaust port 6B configured to allow the exhaust gas, which has been discharged into the casing 6 through the second exhaust port 25, to be discharged to the outside of the casing 6 is opened in the left side plate 60 of the casing 6. The exhaust gas that is discharged from the engine section 2 and stagnates in the casing 6 is discharged to the outside of the casing 6 through the casing-side exhaust port 6B.

A substantially central portion of the partition plate 66 is provided with an opening portion 67 configured to allow the body 3*a* of the pump section 3 to be protruded to the outside through the partition plate 66 of the casing 6. The opening portion 67 is formed in conformity with an outer shape of the heat exchanger block 4.

A sealing member 80 made, for example, of polyurethane and having a vibration damping function and a noise damping function is fitted to a joint part between the heat exchanger block 4 and the partition plate 66.

The sealing member 80 is formed into an annular shape conforming to the outer shape of the heat exchanger block 4 so as to be fitted to an outer peripheral portion of the heat exchanger block 4. When the partition plate 66 is fitted to the opening portion 65 of the casing 6 so as to close the opening portion 65, the partition plate 66 causes the sealing member 80 to be pressed against a block surface of the heat exchanger block 4. With this, the joint part between the heat exchanger block 4 and the partition plate 66 is closed by the sealing member 80.

Note that, in the present invention, the sealing member made, for example, of polyurethane need not necessarily be formed into the annular shape, and may be fitted in a manner of filling the joint part between the pump section 3 and the heat exchanger block 4.

CONCLUSION

As described hereinabove, in the water supply/drainage pump 1 according to the embodiment of the present invention, main passages of the water supply/drainage pump 1, such as the exhaust passage 18 and the cooling passage 13, can be collectively formed within the heat exchanger block 4. Further, only by mounting the heat exchanger block 4 to the body 3*a* of the pump section 3, the chambers 8 and 9 that serve as water supply/drainage passages and the cooling passage 13 can be connected to each other. In this way, piping arrangement can be easily made in the water supply/drainage pump 1. With this, the water supply/drainage pump 1 can be downsized.

Further, noise of the exhaust gas can be damped in the exhaust passage 18. Thus, related-art large mufflers can be omitted.

Still further, the heat exchanger block 4 mounted to the body 3*a* of the pump section 3 is freely removable. Thus, there is an advantage in that removal of the heat exchanger block 4 from the body 3*a* of the pump section 3 facilitates cleaning of the cooling passage 13, the exhaust passage 18, and other parts of the water supply/drainage pump 1.

Yet further, the engine section 2 and the heat exchanger block 4 are covered with the casing 6. With this, driving noise of pistons and cylinders in the engine section 2, driving noise of tappets in the engine section 2, operating noise of the cooling fan of the engine section 2, noise generated by the heat exchanger block 4, and other noises can be restrained from leaking to the outside. In addition, adhesion of dust, for example, to the engine section 2 and the heat exchanger block 4 can be prevented.

Yet further, the heat exchanger block 4 is mounted to the body 3*a* of the pump section 3 between the engine section 2 and the pump section 3. In this structure, with respect to the partition plate 66 of the casing 6, the engine section 2 and the heat exchanger block 4 are located on the inside of the casing 6, and the pump section 3 is located on the outside of the casing 6. Thus, the inlet 3A and the outlets 3B of the pump section 3 are not covered with the casing 6. With this, hoses can be easily connected to/disconnected from the inlet 3A and the outlets 3B.

Yet further, the joint part between the heat exchanger block 4 and the partition plate 66 is closed by the sealing member 80. With this, leakage of the noises in the casing 6 can be prevented. Further, the sealing member 80 has the vibration damping function, and hence vibration to be generated by driving the engine section 2 and vibration to be transmitted to the casing 6 can be absorbed by the sealing member 80.

Yet further, the temperature of the exhaust gas to be discharged from the heat exchanger block 4 into the casing 6 is reduced. Thus, the casing 6 to be used can be downsized.

As a result, the water supply/drainage pump 1 to be provided can be compactified and have both a cooling function and a noise damping function.

The present invention is not limited to the embodiment described hereinabove. Specifically, those skilled in the art may make various modifications, combinations, sub-combinations, and alterations of the components of the above-described embodiment within the technical scope of the present invention or the equivalents thereof.

INDUSTRIAL APPLICABILITY

The present invention is widely applicable to any engine-driven pump configured to supply/drain water, such as an engine-driven pump for washing or other various purposes.

REFERENCE SIGNS LIST

1 water supply/drainage pump
2 engine section
3 pump section
3*a* body
3C opening portion
3D lid member
4 heat exchanger block
6 casing
7 volute chamber
8 first chamber
9 second chamber
10 pump drive shaft
10*a* front end
12 impeller
14A first water inlet
15A first water outlet
18 exhaust passage
19 first exhaust port
20 radiating fin
21 muffler passage
66 partition plate
80 sealing member

What is claimed is:

1. A water supply and drainage pump, comprising:
an engine section;
a pump section configured to supply and drain water by being driven by the engine section; and
a heat exchanger block mounted to a body of the pump section between the engine section and the pump section,
the heat exchanger block comprising:
an exhaust passage connected to an exhaust port for the engine section,
a cooling passage formed along the exhaust passage and being continuous with a water supply and drainage passage formed in the body of the pump section,
a volute chamber formed between the body of the pump section and the heat exchanger block,
wherein the heat exchanger block further comprises:
a water inlet configured to allow water in the water supply and drainage passage to be caused to flow into the cooling passage via the volute chamber; and
a water outlet configured to allow the water in the cooling passage to be drained into the water supply and drainage passage.

2. The water supply and drainage pump according to claim 1, wherein the heat exchanger block further includes a muffler passage continuous with the exhaust passage.

3. The water supply and drainage pump according to claim 1,
wherein the engine section includes a pump drive shaft,
wherein the pump drive shaft has a front end to be inserted into the volute chamber through the heat exchanger block, and includes a water supply and drainage impeller mounted to the front end.

4. The water supply and drainage pump according to claim 1, wherein the exhaust passage includes a radiating fin.

5. The water supply and drainage pump according to claim 1, wherein the heat exchanger block is made of die-cast aluminum.

6. A water supply and drainage pump, comprising:
an engine section;
a pump section configured to supply and drain water by being driven by the engine section; and
a heat exchanger block mounted to a body of the pump section between the engine section and the pump section,
the heat exchanger block comprising:
an exhaust passage connected to an exhaust port for the engine section,
a cooling passage formed along the exhaust passage and being continuous with a water supply and drainage passage formed in the body of the pump section, and
further comprising a casing that is configured to cover the engine section and the heat exchanger block and includes a partition plate,
wherein the engine section and the heat exchanger block are located on an inside of the casing with respect to the partition plate of the casing, and
wherein the pump section is located on an outside of the casing with respect to the partition plate.

7. The water supply and drainage pump according to claim 6, further comprising a sealing member that has a vibration damping function and a noise damping function and is fitted to a joint part between the partition plate and the heat exchanger block.

8. The water supply and drainage pump according to claim 6, wherein the casing is provided with an exhaust port configured to allow air on the inside of the casing to be discharged to the outside of the casing.

9. The water supply and drainage pump according to claim 6, wherein the pump section includes:
an opening portion formed through a front portion of the pump section and communicating to an inside of the pump section; and
a freely openable and closable lid member mounted to the opening portion.

* * * * *